US006427338B1

(12) United States Patent
Schmidt

(10) Patent No.: US 6,427,338 B1
(45) Date of Patent: Aug. 6, 2002

(54) SCISSORS

(75) Inventor: Hardi Schmidt, Solingen (DE)

(73) Assignee: Fromm International, Northbrook, IL (US)

( * ) Notice: Subject to any disclaimer, the term of this patent is extended or adjusted under 35 U.S.C. 154(b) by 0 days.

(21) Appl. No.: 09/763,879

(22) PCT Filed: Jul. 21, 1999

(86) PCT No.: PCT/DE99/02243

§ 371 (c)(1),
(2), (4) Date: Feb. 28, 2001

(87) PCT Pub. No.: WO00/12271

PCT Pub. Date: Mar. 9, 2000

(30) Foreign Application Priority Data

Aug. 29, 1998 (DE) ..... 198 39 488

(51) Int. Cl.[7] ..... B26B 13/12
(52) U.S. Cl. ..... 30/232; 30/341
(58) Field of Search ..... 30/260, 232, 341, 30/340

(56) References Cited

U.S. PATENT DOCUMENTS 3,906,630 A * 9/1975 Megna ..... 30/260
5,430,941 A * 7/1995 Lin ..... 30/260

* cited by examiner

*Primary Examiner*—Douglas D. Watts
(74) *Attorney, Agent, or Firm*—Diller, Ramik & Wight

(57) ABSTRACT

Pair of scissors, in particular hair-cutting scissors, consisting of two scissor halves (1, 2), each comprising a scissor blade and a tang (3) with a grip eye (4, 5, 6, 7), where the grip eye (4, 5, 6, 7) of at least one scissor half (2) is mounted such that it can slide essentially parallel to the tang (3) and be locked in position. The inventive activity consists in the fact that the sliding grip eye (4, 5, 6, 7) is integrally molded on a first handle section (8), and a second handle section (9)is mounted on the tang (3), where the first handle sect-ion (8) can be slid onto the free end of the second handle section (9) and, in this position, can be snapped onto the second handle section (9) in releasable fashion without any adjusting elements, and where the two handle sections (8, 9) form a uniformly closed handle with smooth transitions without disturbing adjusting elements.

12 Claims, 4 Drawing Sheets

Fig. 6
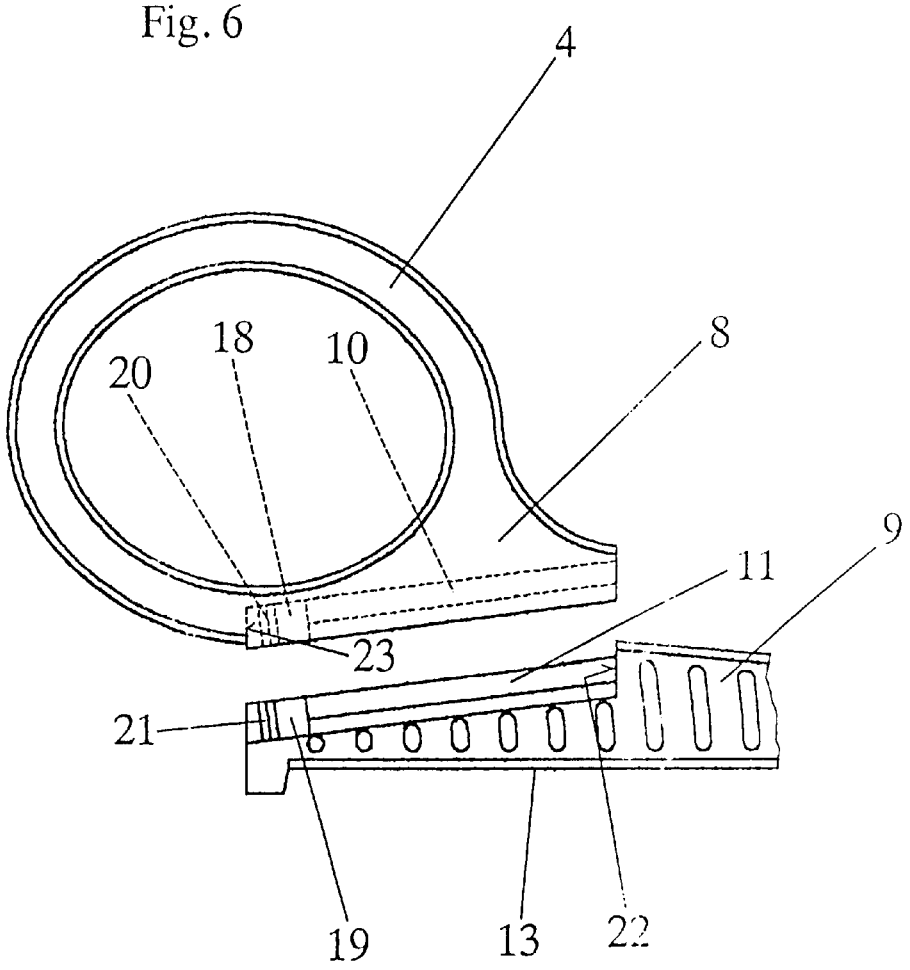
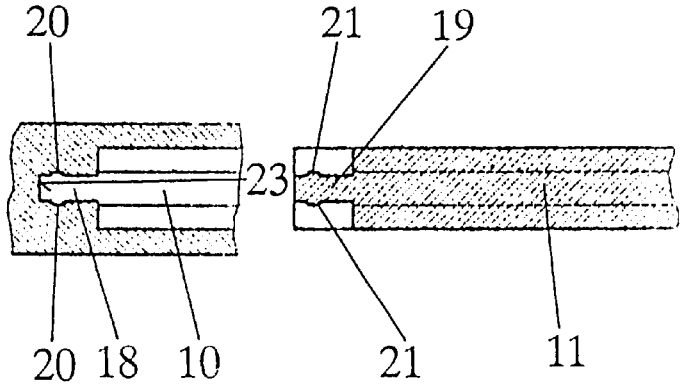
Fig. 7

SCISSORS

The invention concerns a pair of scissors, in particular hair-cutting scissors, with two scissor halves, each comprising a scissor blade and a tang with a grip eye, where the grip eye of at least one scissor half is mounted such that it can slide essentially parallel to the tang and be locked in position.

Scissors of this kind are known from DE 36 15 753 A1. In these scissors, the distance between the grip eye and the scissor blade can be essentially varied infinitely using one or more adjusting screws. This is intended to enable adaptation to the size and general shape of the user's hand.

The disadvantage of these scissors is that, when the grip eye is fixed in a position on the tang which is relatively far away from the scissor blade, the sliding grip eye and the associated tang do not form a uniformly closed handle with an attractive design without disturbing adjusting elements and areas.

The object of the invention is to improve the design of a pair of scissors of the type described in the opening paragraph such that the above-mentioned disadvantages can be avoided.

According to the invention, the object is solved in that the sliding grip eye is integrally molded to a first handle section, and a second handle section is mounted on the tang, where the first handle section can be slid onto the free end of the second handle section and, in this position, can be snapped onto the second handle section in releasable fashion without any adjusting elements, and where the two handle sections form a uniformly closed handle with smooth transitions without disturbing adjusting elements.

Due to the fact that the first handle section with the grip eye can only be snapped onto the second handle section provided on the tang when it has been completely slid onto it, and that no adjusting elements are provided, the scissors can be designed in such a way that the two handle sections form a uniformly closed handle with smooth transitions without disturbing adjusting elements and areas. The sliding of the first handle section with the grip eye onto the second handle section and its snap connection, which is made only when the first handle section is completely slid on, serve only to secure the grip eye in this case. The distance between the grip eye and the scissor blade cannot be adjusted in the design according to the invention.

Adaptation to the size and general shape of the user's hand is achieved by several grip eyes of different design, which are integrally moulded on the first handle sections and can be mounted on the second handle section in interchangeable fashion. The design can differ in that the first handle sections are of various lengths, so that the interchangeable grip eyes are at different distances from the scissor blade. On the other hand, different grip eye sizes and/or shapes, e.g. with and without finger hook, can be provided for first handle sections of the same or different length.

In a preferred configuration of the invention, the two handle sections are provided with a tongue-and-groove joint on the sides facing one another for the purpose of sliding relative to one an other.

This type of joint can be designed in such a way that the first handle section has a T-groove extending in the longitudinal direction and open towards the scissor blade and the second handle section has a tongue with a T-shaped cross-section in the region of its free end, which interacts with the T-groove. In another configuration, the T-groove can also be provided on the second handle section and the tongue with the T-shaped cross-section on the first handle section.

Tongue-and-groove joints with a different cross-section, such as dovetail joints , are also feasible.

In a preferred configuration, the T-groove and the tongue are angled slightly outwards relative to the longitudinal direction of the handle as they extend towards the scissor blade. This ensures a stable connection between the first and second handle sections with sufficient material thickness in the particularly stressed areas and a uniform and closed shape of the handle, which can be designed to be symmetrical to the handle of the other scissor half.

In this context, the thickness of the end of the first handle section pointing towards the scissor blade essentially corresponds to that of the T-groove, and the thickness of the free end of the second handle section essentially to that of the tongue.

For the snap connection of the two handle sections, the end region of the T-groove pointing towards the scissor blade can be provided with an outward-facing recess, and the end region of the tongue pointing towards the scissor blade with a nib which interacts with the recess.

In another solution, the end region of the T-groove pointing towards the scissor blade is provided with two lateral recesses, and the end region of the tongue pointing towards the scissor blade with two lateral nibs which interact with the recesses.

Recesses and nibs can, of course, also be provided in other suitable areas of the tongue-and-groove joint of the two handle sections.

In another configuration of the snap connection, the end region of the T-groove pointing away from the scissor blade can be provided with an extension without the two sides of the "T", and the tongue with a corresponding extension with a rectangular cross-section, the extension of the T-groove being provided with two lateral recesses, and the extension of the tongue with two corresponding nibs. The recesses and nibs can extend perpendicular to the longitudinal direction of the groove or tongue along the entire side sections.

In a preferred configuration, the groove and the tongue have stop surfaces on their two ends in order to limit the sliding of the first handle section onto the second handle section.

Several preferred practical examples of the invention are described in detail below based on the drawing.

The drawings show the following:

DESCRIPTION OF THE PREFERRED EMBODIMENTS

Figure 1:
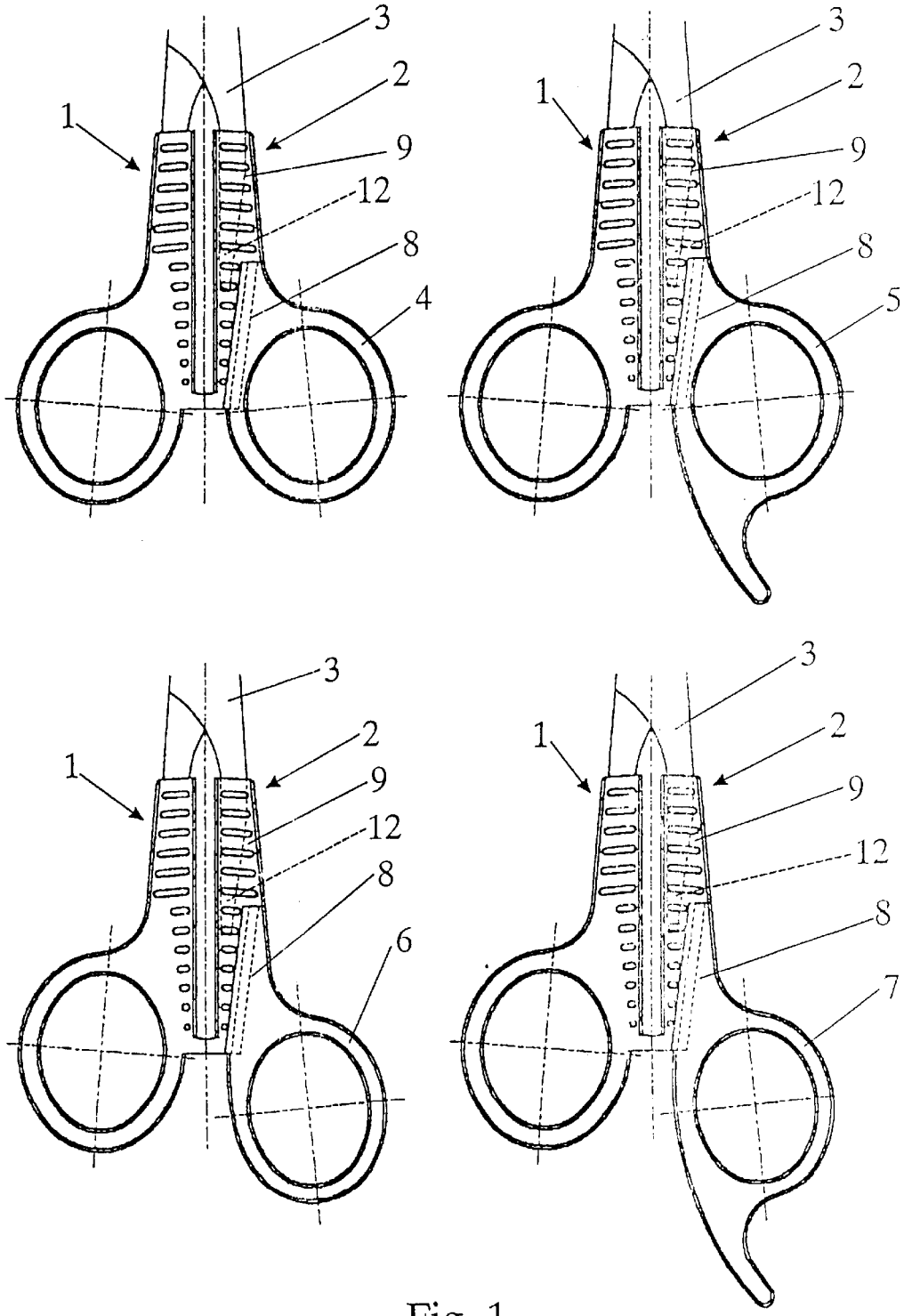
FIG. 1 Four different grip eyes mounted on a pair of scissors.
Figure 2:
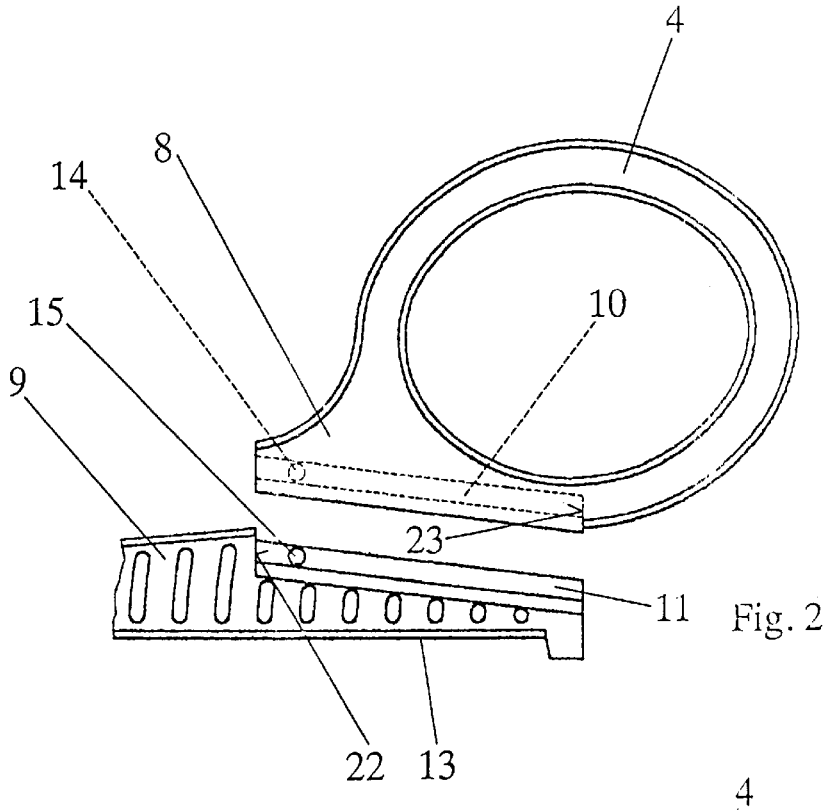
FIG. 2 Illustration of a tongue-and-groove joint between grip eye and scissor handle, FIG. 3 Illustration of a second tongue-and-groove joint between grip eye and scissor handle, FIG. 4 Illustration of the grip eye in FIG. 3 secured by sliding onto the scissor handle, FIG. 5 Cross-section along Line V—V in FIG. 4, FIG. 6 Illustration of a third tongue-and-groove joint between grip eye and scissor handle, and FIG. 7 Top view of the sides of the tongue-and-groove joint facing one another in FIG. 6.

As shown in FIG. 1, the scissors consist of two scissor halves 1 and 2, each comprising a scissor blade (not shown) and a tang 3 with a grip eye 4, 5, 6 or 7. On one scissor half, grip eye 4, 5, 6 or 7 is integrally molded on a first handle section 8 and, when slid onto the free end of a second handle section 9, is secured on second handle section 9 via a tongue-and-groove joint. Second handle section 9, which can be made of plastic, is mounted on tang 3 made of metal.

While the design of first handle section 8 remains the same, grip eyes 4, 5, 6 and 7 are of different design, so that they can be used to adapt the same pair of scissors to the respective hand size and preferred work habits of the user.

In the practical examples shown in FIG. 1, the scissor handles with the grip eyes are mounted as separate parts on tangs 3 of scissor halves 1 and 2. However, the handles can also be integrally molded on tangs 3, in which case second handle section 9 forms a single part with tang 3.

The tongue-and-groove joint between the two handle sections 8 and 9, which is further described below, is positioned and designed in such a way that the two handle sections 8 and 9 form a uniformly closed handle with smooth transitions, the outer design of which is not impaired by the tongue-and-groove joint and matches the design of the handle of the other scissor half 1.

FIGS. 2 to 5 show a tongue-and-groove joint between first handle section 8 and second handle section 9 with different types of snap elements. The snap elements provide for a releasable snap connection between the two handle sections 8 and 9 when first handle section 8 is slid completely onto second handle section 9.

Figure 5:
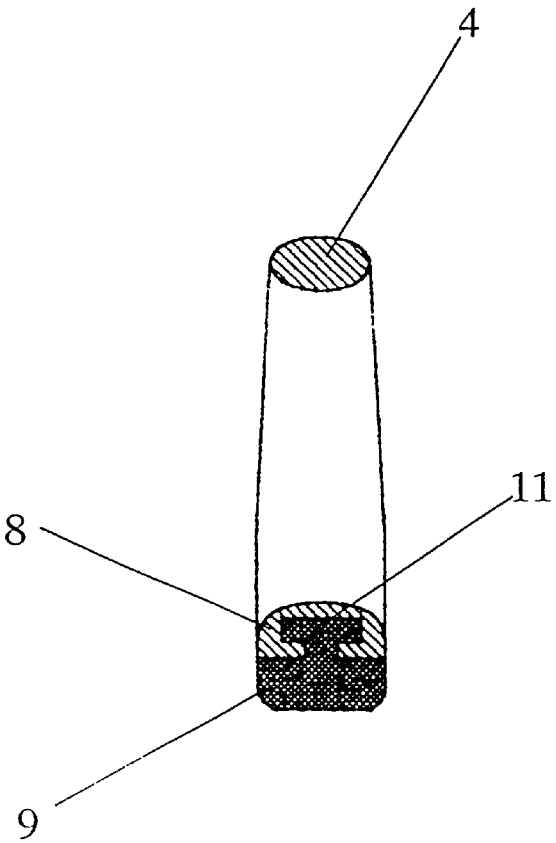

As is particularly clearly shown in the cross-sectional view in FIG. 5, the two handle sections 8 and 9 are provided with a tongue-and-groove joint on the sides facing one another for the purpose of sliding relative to one another. To this end, first handle section 8 is provided with a T-groove 10 extending in the longitudinal direction and open towards the scissor blade, which interacts with a tongue 11 with a T-shaped cross-section provided in the region of the free end of second handle section 9. T-groove 10 and tongue 11 are angled slightly outwards relative to the longitudinal direction of the handle as they extend towards the scissor blade. As a result of this design, a tapered section 12 of tang 3 can extend into the region between tongue 11 and inner side 13 of second handle section 9. In the joint shown in FIG. 2, the end region of T-groove 10 pointing towards the scissor blade is provided with an outward-facing recess 14, and the end region of tongue 11 pointing towards the scissor blade with nibs 15 which interact with recess 14.

Figure 3:
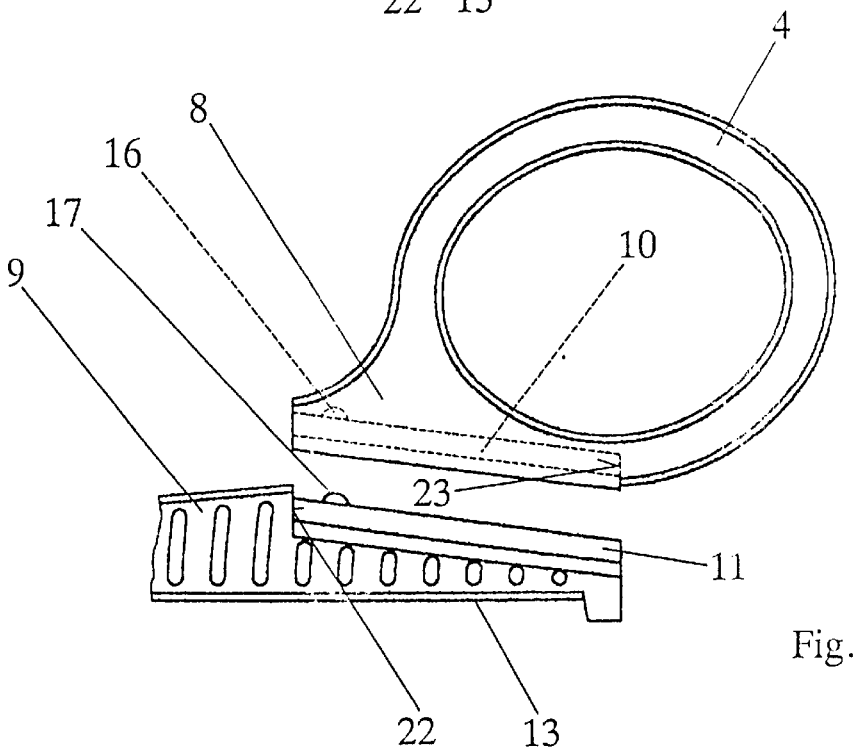
Figure 4:
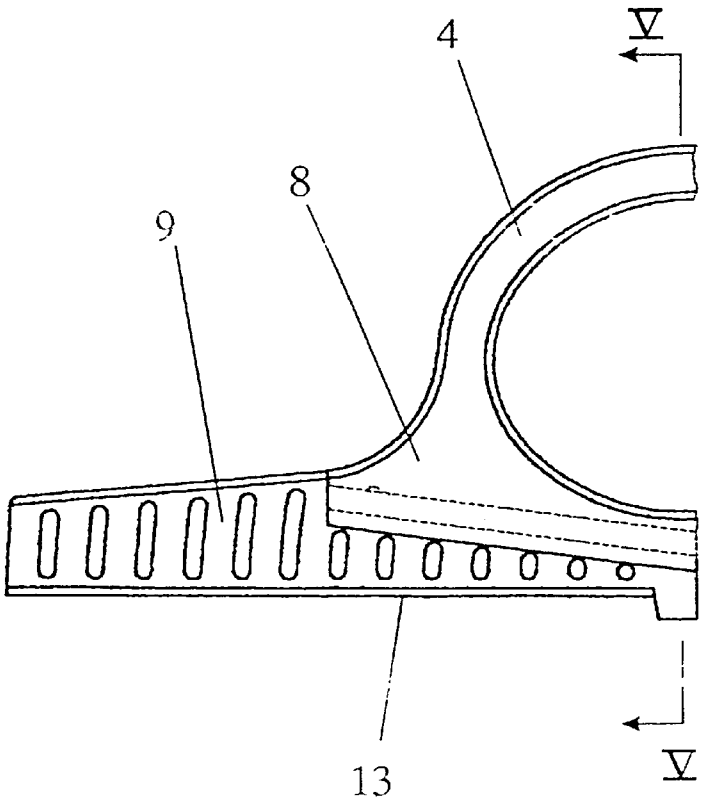

In the practical example shown in FIG. 3, the end region of T-groove 10 pointing towards the scissor blade is provided with two lateral recesses 16, and the end region of tongue 11 pointing towards the scissor blade with two lateral nibs 17 which interact with recesses 16.

FIGS. 6 and 7 show a third practical example, in which the end region of T-groove 10 pointing away from the scissor blade is provided with an extension 18 without the two sides of the "T", and tongue 11 with a corresponding extension 19 with a rectangular cross-section, extension 18 of T-groove 10 being provided with two lateral recesses 20, and extension 19 of tongue 11 with two corresponding nibs 21. Recesses 20 and nibs 21 extend, as shown in FIG. 6, essentially perpendicular to the longitudinal direction of the groove and tongue along the entire side sections of extensions 18 and 19.

T-groove 10 and tongue 11 have stop surfaces 22 and 23 on their two ends in order to limit the sliding of first handle section 8 onto second handle section 9 into the locked position.

Although a preferred embodiment of the invention has been specifically illustrated and described herein, it is to be understood that minor variations may be made in the apparatus without departing from the spirit and scope of the invention, as defined by the appended claims.

List of Reference Numbers

1 Scissor half
2 Scissor half
3 Tang
4 Grip eye
5 Grip eye
6 Grip eye
7 Grip eye
8 First handle section
9 Second handle section
10 T-groove
11 Tongue
12 Tapered section
13 Inner side
14 Recess
15 Nib
16 Recess
17 Nib
18 Extension
19 Extension
20 Recess
21 Nib
22 Stop surface
23 Stop surface

What is claimed is:

1. A scissors comprising scissors halves (1, 2) each including a scissors blade, at least one of said scissors blades terminating in two handle sections (8, 9), a first (8) of said two handle sections defining an end portion of its associated scissors blade, a second (9) of said two handle sections including a grip eye (4, 5, 6 or 7), means (10, 11) for slidably connecting and unconnecting said handle sections relative to each other, and means (14, 15; 16, 17 or 20, 21) for detachably securing said first handle section (8) to said second handle section (9) absent any relative adjustment therebetween when the handle sections (8, 9) are in complete slidable connected relationship to each other and only upon the two handle sections (8, 9) forming a substantially uniform continuous handle with contiguous substantially smooth transition surfaces of said two handle sections (8, 9).

2. The scissors as defined in claim 1 wherein said first handle section (8) is integrally molded to said associated scissors blade.

3. The scissors as defined in claim 1 wherein said securing means (14, 15; 16, 17; 20, 21) are cooperative nibs and recesses of said handle sections (8, 9).

4. The scissors as defined in claim 1 wherein said slidable connecting and unconnecting means (10, 11) include a longitudinal extending groove (10) open at one longitudinal end of one of said first and second handle sections (8, 9), and another of said first and second handle sections (8, 9) includes a longitudinally extending tongue (11) substantially corresponding in transverse cross-section to said longitudinally extending groove (10).

5. The scissors as defined in claim 1 wherein said slidable connecting and unconnecting means (10, 11) include a longitudinal extending groove (10) open at one longitudinal end of one of said first and second handle sections (8, 9), another of said first and second handle sections (8, 9) includes a longitudinally extending tongue (11) substantially corresponding in transverse cross-section to said longitudinally extending groove (10), and said tongue (11) and groove (10) are of a substantially T-shaped configuration in transverse cross-section.

6. The scissors as defined in claim 1 wherein said slidable connecting and unconnecting means (10, 11) include a longitudinal extending groove (10) open at one longitudinal end of one of said first and second handle sections (8, 9), another of said first and second handle sections (8, 9) includes a longitudinally extending tongue (11) substantially corresponding in transverse cross-section to said longitudinally extending groove (10), and said tongue (11) and groove (10) are angled slightly outwardly in diverging relationship relative to the longitudinal extent of said tongue (11) and groove (10).

7. The scissors as defined in claim 4 wherein said detachable securing means (14, 15; 20, 21) are recesses (14, 20) and nibs (15, 21) respectively opening and projecting laterally relative to a respective one of said tongue (11) and groove (10).

8. The scissors as defined in claim 4 wherein said detachable securing means (16, 17) are recesses (14) and nibs (15) respectively opening and projecting outwardly and away from a respective one of said tongue (11) and groove (10).

9. The scissors as defined in claim 4 wherein said detachable securing means (20, 21) are recesses (20) and nibs (21) respectively opening and projecting laterally relative to a respective one of said tongue (11) and groove (10), said nibs (21) are carried by an extension (19) of said tongue (11), and said nibs (21) are located beyond an extension (18) of said groove (10).

10. The scissors as defined in claim 4 wherein said detachable securing means (14, 15; 16, 17) are disposed remote from a blind end (23) of said groove (10) in the complete slidable connected relationship of the two handle sections (8, 9).

11. The scissors as defined in claim 4 wherein said detachable securing means (14, 15; 16, 17) are disposed adjacent to a blind end (23) of said groove (10) in the complete slidable connected relationship of the two handle sections (8, 9).

12. The scissors as defined in claim 7 wherein said nibs and recesses (14, 15; 16, 17; 20, 21) are disposed in pairs on opposite sides of one of said tongue (11) and groove (10).

* * * * *